United States Patent [19]

Main

[11] Patent Number: 4,924,540

[45] Date of Patent: May 15, 1990

[54] PILLOW

[75] Inventor: Ewan J. Main, Brampton, Canada

[73] Assignee: The Woodbridge Group, Ontario, Canada

[21] Appl. No.: 341,324

[22] Filed: Apr. 21, 1989

[51] Int. Cl.[5] ..... A47G 9/00

[52] U.S. Cl. ..... 5/436; 5/434; 5/490

[58] Field of Search ..... 5/434, 436, 431, 437, 5/441, 490; D6/601

[56] References Cited

U.S. PATENT DOCUMENTS

| | | | |
|---|---|---|---|
| 1,973,240 | 9/1934 | Werness et al. | 5/436 |
| 2,769,185 | 11/1956 | Biederman | 5/436 |
| 3,426,372 | 2/1969 | Enelow | 5/434 |
| 3,757,365 | 9/1973 | Kretchmer | 5/436 |
| 3,829,917 | 8/1974 | De Laittre et al. | 5/436 |
| 4,349,925 | 9/1982 | Macomber | 5/436 |
| 4,432,107 | 2/1984 | Clark et al. | 5/436 |
| 4,759,089 | 7/1988 | Fox | 5/434 |
| 4,773,107 | 9/1988 | Josefek | 5/434 |
| 4,777,855 | 10/1988 | Cohen | 5/434 |

FOREIGN PATENT DOCUMENTS

| | | | |
|---|---|---|---|
| –36813 | 1/1970 | Australia | 5/436 |
| 1321716 | 6/1973 | United Kingdom | 5/434 |

*Primary Examiner*—Alexander Grosz
*Attorney, Agent, or Firm*—Nixon & Vanderhye

[57] ABSTRACT

A pillow formed from a resilient foam material is provided. The pillow is of unitary construction and includes a generally concave upper surface for supporting a user's head. Two opposite sides of the pillow each have a generally ovate recess formed therein that extends along the length of the side. The recesses define upper and lower ridges on each side of the pillow which are aligned when the pillow is not in use. The recesses are adapted to receive the user's shoulder during use. The upper surface of the pillow is provided with a plurality of spaced ridges formed thereon that extend diagonally across the upper surface. The ridges extend across substantially the entire upper surface except at two substantially flat semi-circular regions. Each semi-circular region is located adjacent one of the two upper ridges and provides support along the jaw-line of the user. It is preferred that one side of the pillow is raised with respect to the other side and that the recess formed in the one side is of larger dimensions than the recess provided in the other side to accommodate user's of different physical size.

21 Claims, 3 Drawing Sheets

PILLOW

The present invention relates to a pillow.

Pillows are well known in the art and have been the subject of many developments to improve comfort and support. In particular, U.S. Pat. No. 4,432,107 to Clark shows a number of embodiments of a pillow. One end of each of the pillows shown in this reference has an upper edge and a lower edge, the upper edge having a ridge which projects forwardly of the lower edge. The forwardly extending ridge is arranged so that in use the ridge can tuck into and hence support the lower neck region of a person lying on his/her side with his/her head resting on the pillow.

However, a problem exists in the Clark pillow in that the shape of the pillow does not mimic the shape of the shoulder on the lower surface nor does the ridge itself properly fill the natural void between the neck and the shoulder. This design of the Clark pillow requires either the ridge to be very firm to provide the proper support making it uncomfortable or requires the ridge to be allowed to deform substantially to fill the void. However, the latter design detracts significantly from the overall neck support and may permit tearing of the pillow. The latter case has been considered by Clark as is evident from the last paragraph of the Clark reference which states that the pillow may tear under pressure exerted by the head and the neck unless the pillow is reinforced using a dense outer skin.

Moreover, another problem exists in the Clark pillow in that the shape of the pillow does not accommodate sleeping in the back position since the pressure applied to the ridge by the head will cause the pillow to lift from the bed. Accordingly, there is a need for a novel pillow.

It is therefore an object of the present invention to obviate or mitigate the above disadvantages.

Broadly stated, the present invention provides a pillow comprising: a resilient body including one side having a recess formed therein for receiving the shoulder of a user, said recess extending along a substantial portion of the length of said one side, said recess defining substantially aligned upper and lower ridges and a pair of generally vertical sections adjacent opposite ends of said one side extending between said upper and lower ridges.

Preferably, the pillow includes a second side located opposite the first side having a configuration similar to that of the first side. It is also preferred that the upper and lower ridges defined by the recesses are aligned when the pillow is not in use. However, it is also preferred that the dimensions of the second side and the recess formed therein be reduced with respect to the first side to accommodate users of smaller physical size.

Preferably, the upper surface is concave in shape yet includes a substantially flat semi-circular region at each side of the pillow adjacent the upper ridge. It is also preferred that the concave portion of the upper surface has a plurality of diagonally extending ridges formed thereon.

In another aspect of the present invention there is provided in combination, a pillow casing and a pillow, said pillow casing enclosing said pillow, said pillow comprising a resilient body having a generally concave upper surface and a pair of opposed sides extending downwardly therefrom, one of said sides being raised with respect to the other, each of said sides having a recess formed therein to define substantially aligned upper and lower ridges.

The present pillow provides advantages in that since the upper and lower ridges are substantially aligned when the pillow is not in use, the regions of the body adjacent the lower ridges and the recesses support the upper ridge to increase the stability of the upper ridges as they deform when the pillow is supporting a user's head. Furthermore, the provision of the semi-circular flat portions adjacent the upper ridges provide additional support along the jaw-line of the user.

An embodiment of the present invention will now be described by way of example only with reference to the accompanying drawings in which.

Figure 1:
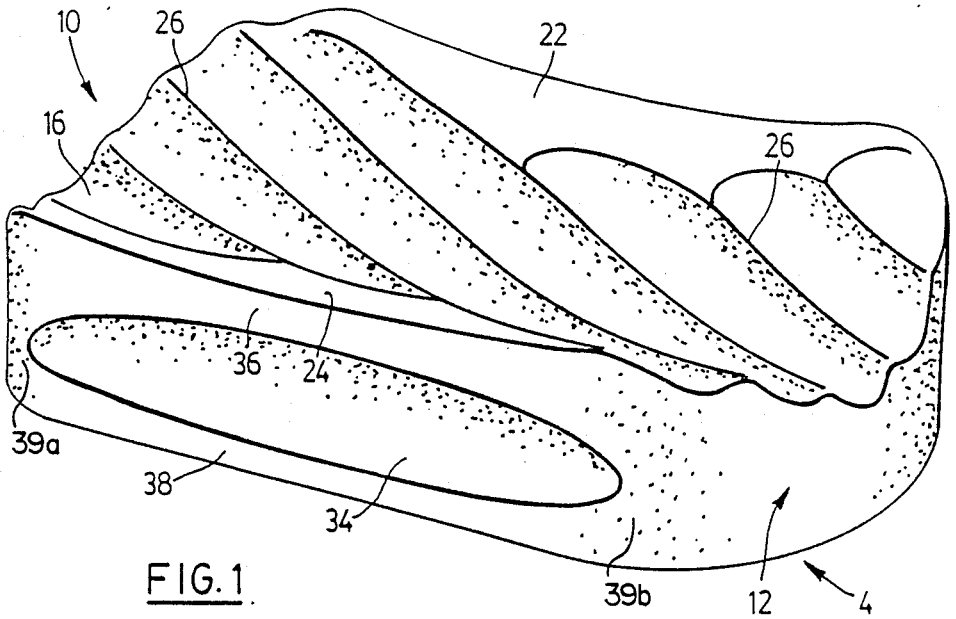
FIG. 1 is a perspective view of a pillow taken from above and from one side.
Figure 2:
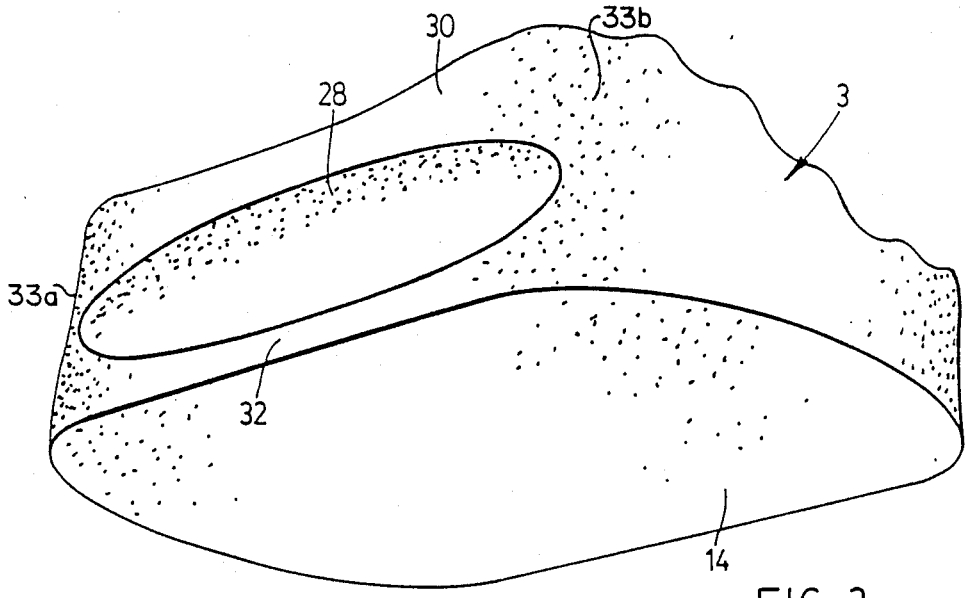
FIG. 2 is a perspective view of the pillow shown in FIG. 1 taken from below and from one side.
Figure 3:
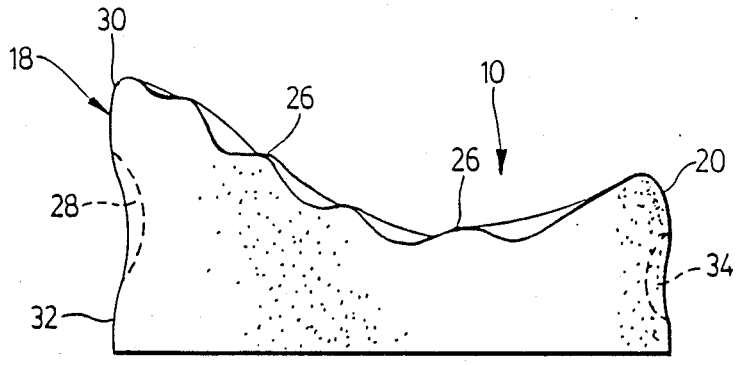
FIG. 3 is a side view of the pillow illustrated in FIG. 2 taken along arrow 3.

Referring to FIGS. 1 to 3, a pillow is shown and indicated generally with reference numeral 10. The pillow 10 comprises a resilient body 12 of unitary construction formed from "High Resiliency" formulation polyurethane. The body 12 includes a generally flat lower surface 14 and an upper surface 16 having a generally concave shape. The concave shape of the upper surface 16 is configured so that one side 18 of the pillow 10 is raised with respect to the other side 20 of the pillow, the purposes of which will be described hereinafter. Although the upper surface 16 is generally concave in shape, two generally flat semi-circular regions 22,24 are provided thereon with each region 22,24 being located adjacent one of the sides 18 and 20 respectively. A plurality of spaced ridges 26 are formed on the concave shaped portion of the upper surface 16 and extend diagonally thereacross.

Side 18 of the pillow 10 has a generally ovate recess 28 formed therein which extends substantially along the length of the side to define upper and lower ridges 30 and 32 respectively a pair of generally vertical sections **33*a* and 33*b* located adjacent opposite ends of the side 18. The pillow 10 is configured in a manner so that the upper ridge 30 is aligned with the lower ridge 32 when the pillow is not in use. In other words, the upper and lower ridges lie in the same vertical plane when the pillow 10** is in a rest position.

Side 20 of the pillow 10 has a configuration similar to that of side 18 although the vertical dimensions of side 20 are smaller than the corresponding dimensions of side 18. As can be seen, side 20 also has a generally ovate recess 34 formed therein which is of smaller dimensions than recess 28. However, recess 34 extends substantially along the length of the side 20 to define upper and lower ridges 36 and 38 respectively, as well as generally vertical sections **39*a* and 39*b*. Similarly, the upper ridge 36 is aligned with the lower ridge 38 when the pillow is not in use. The regions of the body 12 adjacent the lower ridges 32,38 and the recesses 28,34 provide support for the upper ridges 30,36 in their rest and in use positions. This support provided to the upper ridges 30,36 inhibits tearing of the body 12 during deformation of the pillow 10** that occurs during use of the pillow as will be described.

Figure 4:
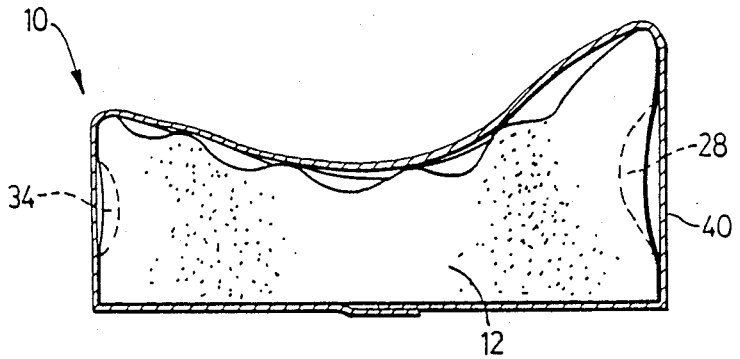
FIG. 4 is a side view of the pillow shown in FIG. 1 taken along arrow 4.
Figure 5:
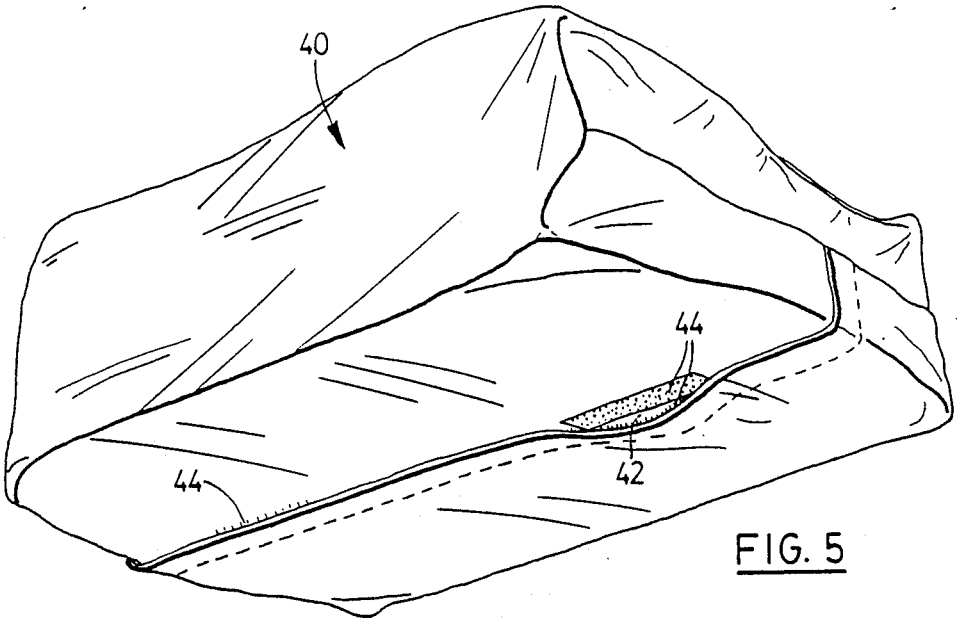
FIG. 5 is a perspective view of a pillow enclosed in a pillow case.
Figure 6:
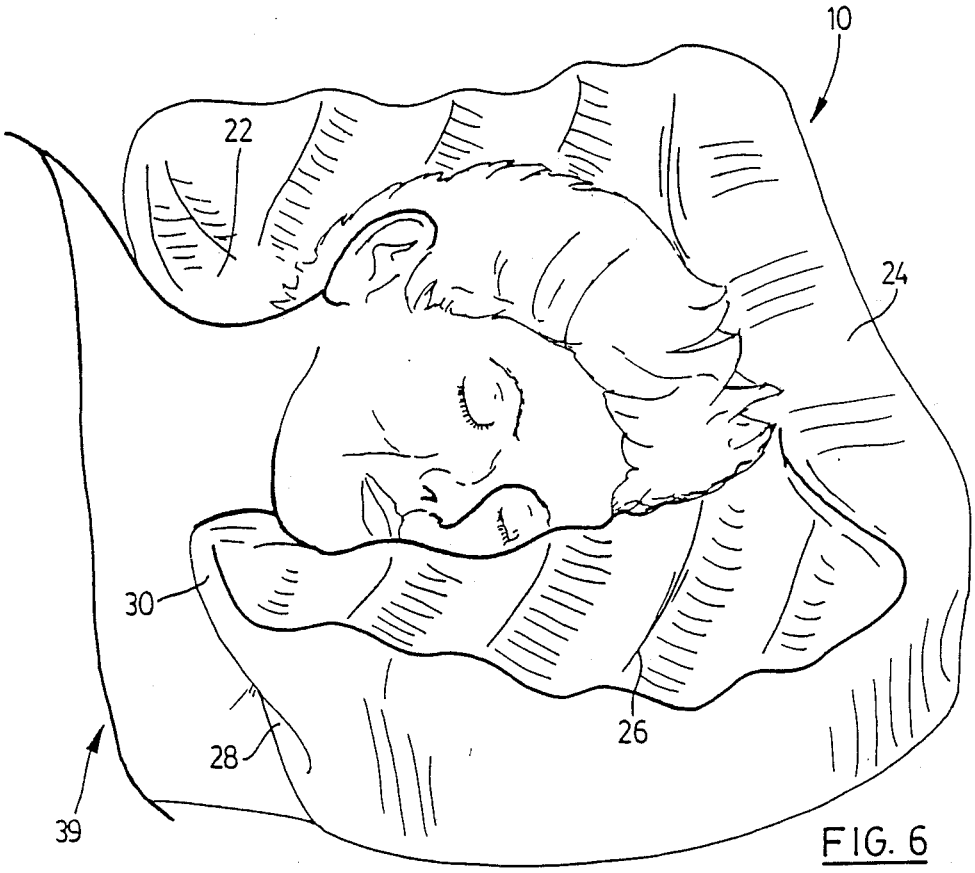
FIG. 6 is a perspective view of the pillow illustrated in FIG. 1 in use.

The use of the pillow will now be described with particular reference to FIGS. 4 to 6. When a person 39 uses the pillow, the pillow 10 can be enclosed in a pillow case 40 such as that illustrated in FIGS. 4 and 5 to prevent direct contact between the person and the body 12 of the pillow 10. The pillow case 40 as shown includes an opening 42 extending substantially along the length of the pillow case. Velcro TM tape 44 is provided at spaced locations along the opening 42 so that the opening 42 can be sealed. The opening 42 is designed to facilitate insertion of the pillow 10 into the interior of the pillow case. Once the pillow 10 is positioned in the pillow case 40, the opening 42 can then be sealed by joining the tape 44. This inhibits dirt from accumulating on the resilient foam body 12 of the pillow.

Once the pillow 10 has been enclosed in the pillow case 40 and the pillow is to support a person or if the pillow is to be used without a pillow case, the shoulder of the person 39 is positioned so that it tucks into the recess formed in one of the two sides 18,20 of the pillow. The side 18,20 of the pillow that is used to accommodate the shoulder of the person is chosen depending on the physical side of the person. The raised side 18 of the pillow 10 will accommodate persons of greater physical size due to the enlarged recess 28 whilst the other side 20 is more suitable for persons of smaller stature.

Use of the pillow 10 will now be described for a person using side 18 of the pillow to accommodate the shoulder. It should however, be apparent that the pillow 10 functions in the same manner if side 20 is used to accommodate the shoulder. As is evident from FIG. 6, once the person's shoulder is tucked into recess 28, the head of the person 39 is placed on the upper surface 16 so that the ridge 30 tucks into the lower neck region of the person to provide the necessary support. The semi-circular region 22 extending adjacent ridge 30 provides support for the jaw-line of the person. The semi-circular shape of the region 22 generally conforms with the orientation of the jaw-line during sleeping and provides support along the jaw-line even if the person's head rolls from side to side.

The provision of the ridges 26 on the upper surface provide an initial soft feeling as the head is brought into contact with the pillow 10 since the ridges 26 give way quickly under the exerted pressure. However, the ridges 26 once collapsed exert pressure against the person's head. Since the ridges 26 are spaced, the pressure exerted by the pillow on the person varies over the supported area. The diagonal orientation of the ridges ensures that the regions of high and low pressure applied to the person's head shift as the person rolls his/her head during sleeping thereby creating a massaging effect.

The downward pressure exerted on the upper surface 16 by the person's head also causes on one side 18 of the pillow 10 to deform so that the upper ridge 30 projects downwardly and forwardly from its rest position. The deformation of the pillow is dependant on the size of the person's shoulder tucked in the recess 28. The positioning of the upper ridge 30 fills the natural void formed between the neck and the shoulder of the user as well as supports firmly the lower neck region of the person 39. The semi-circular region 22 and concave upper surface 16 provide the necessary support for the upper neck region and head. In addition to providing full support, the present pillow also improves comfort.

The prevent invention provides advantages in that the provision of each lower ridge in alignment with its respective upper ridge provides support for the upper ridge and inhibits tearing of the pillow when downward pressures are applied to the upper surface during use. Furthermore, by providing opposite sides having similar configurations yet reduced dimensions, the pillow can accommodate user's having different dimensions. Moreover, the provision of the diagonally extending ridges and the generally flat semi-circular regions on the upper surface provide increased comfort and support.

It should be apparent that the present pillow although described as being formed from polyurethane can be formed from any suitable resilient material that is capable of withstanding the pressures applied thereto during use. It should also be realized that the upper ridge need not be aligned with the lower ridge but can also be positioned so the it is located slightly behind the lower ridge when the pillow is not in use. It should also be apparent that other recess configurations can be used provided that the shape of the recess is suitable for accommodating a shoulder.

It should be apparent to one of skill in the art that the present pillow can be modified without departing from the scope of the present invention which is defined by the appended claims.

We claim:

1. A pillow comprising: a body formed from a resilient material, said body including a generally concave upper surface for supporting a user's head and a pair of sides extending downwardly from said upper surface, one of said sides being raised with respect to the other of said sides, each of said sides having a generally ovate recess formed therein for receiving the shoulder of a user, the recess provided in said other side being of smaller dimensions than the recess provided in said one side, each of said recesses extending substantially along the length of said respective side to define substantially aligned upper and lower ridges.

2. The pillow as defined in claim 1 wherein said upper surface further includes a plurality of spaced ridges formed thereon, said spaced ridges extending diagonally across said upper surface.

3. The pillow as defined in claim 2 wherein said upper surface further includes a pair of substantially horizontal, generally semi-circular regions, each of said regions being located adjacent one of said upper ridges.

4. The pillow as defined in claim 3 wherein said body is formed from foamed polyurethane.

5. The pillow as defined in claim 3 wherein said substantially horizontal, generally semi-circular regions are free from said spaced ridges.

6. A pillow comprising:

a resilient body comprising an upper surface adapted to support the head of a user and including one side having a recess formed therein for receiving the shoulder of a user while the head of the user is supported on said upper surface, said recess extending along a substantial portion of the length of said one side, said recess defining substantially aligned upper and lower ridges and a pair of generally vertical sections adjacent opposite ends of said one side extending between said upper and lower ridges.

7. The pillow as defined as defined in claim 6 wherein said body includes another side located opposite said one side, said other side having a second recess formed therein to define upper and lower ridges and a pair of generally vertical sections adjacent opposite ends of said other side.

8. The pillow as defined in claim 7 further including a generally concave upper surface and wherein said one side is raised with respect to said other side, said second recess being of smaller dimensions than said one recess.

9. The pillow as defined in claim 8 wherein said upper surface further includes a plurality of spaced ridges formed thereon, said ridges extending diagonally across said upper surface.

10. The pillow as defined in claim 9 wherein said upper surface further includes a pair of substantially horizontal, generally semi-circular regions, each of said regions being located adjacent one of said upper ridges and being free from said spaced ridges.

11. The pillow as defined in claim 6 wherein said recess is generally ovate in shape.

12. The pillow as defined in claim 6 further including a generally concave upper surface and a substantially horizontal, generally semi-circular region adjacent said upper ridge, said region being configured to provide support along the jawline of a user.

13. The pillow as defined in claim 12 wherein said upper surface includes a plurality of spaced ridges formed thereon, said ridges extending diagonally across said upper surface.

14. A pillow comprising:

a resilient body having a generally concave upper surface adapted to support the head of a user and a pair of opposed sides extending downwardly therefrom, one of said sides being raised with respect to the other of said sides, each of said sides having a recess formed therein to define substantially aligned upper and lower ridges said recesses being adapted to support the shoulder of a user while the head of the user is being supported on said upper surface.

15. The pillow defined in claim 14 wherein the recess formed in said other side is of smaller dimensions than the recess formed in said one side.

16. The pillow as defined in claim 15 wherein said upper surface further includes a pair of substantially horizontal, generally semi-circular regions, each of said regions being located adjacent one of said of upper regions.

17. The pillow as defined in claim 16 wherein said upper surface includes a plurality of spaced ridges formed thereon, said spaced ridges extending diagonally across said upper surface.

18. The pillow as defined in claim 17 wherein said substantially horizontal, generally semi-circular regions are free from said spaced ridges.

19. In combination, a pillow casing and a pillow, said pillow casing enclosing said pillow, said pillow comprising a resilient body having a generally concave upper surface adapted to support the head of a user and a pair of opposed sides extending downwardly therefrom, one of said sides being raised with respect to the other, each of said sides having a recess formed therein to define substantially aligned upper and lower ridges said recesses being adapted to support the shoulder or a user while the head of the user is being supported on said upper surface.

20. The combination as defined in claim 19 wherein said pillow casing is provided with an opening to allow said pillow to be removed therefrom.

21. The combination as defined in claim 20 wherein said opening is positioned on said pillow casing so that said opening extends along the bottom of said pillow, said opening being releasably sealable.

* * * * *